US010856061B2

(12) United States Patent
Umesako et al.

(10) Patent No.: US 10,856,061 B2
(45) Date of Patent: Dec. 1, 2020

(54) SPEAKER DEVICE

(71) Applicant: Panasonic Intellectual Property Management Co., Ltd., Osaka (JP)

(72) Inventors: Minoru Umesako, Hyogo (JP); Takuto Takizawa, Osaka (JP); Yukiharu Wakiguchi, Osaka (JP); Hiroya Morikawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/312,543

(22) PCT Filed: Jul. 4, 2017

(86) PCT No.: PCT/JP2017/024475
§ 371 (c)(1),
(2) Date: Dec. 21, 2018

(87) PCT Pub. No.: WO2018/012350
PCT Pub. Date: Jan. 18, 2018

(65) Prior Publication Data

US 2019/0261075 A1 Aug. 22, 2019

(30) Foreign Application Priority Data

Jul. 11, 2016 (JP) ..... 2016-137182

(51) Int. Cl.
*H04R 1/28* (2006.01)
*H04R 1/02* (2006.01)
(Continued)

(52) U.S. Cl.
CPC ..... *H04R 1/028* (2013.01); *H04R 1/025* (2013.01); *H04R 1/26* (2013.01); *H04R 1/28* (2013.01); *H04R 1/34* (2013.01); *H04R 1/345* (2013.01)

(58) Field of Classification Search
CPC combination set(s) only.
See application file for complete search history.

(56) References Cited

U.S. PATENT DOCUMENTS

2007/0201712 A1* 8/2007 Saiki ..... H04R 1/2834 381/186
2011/0188678 A1 8/2011 Lee et al.
(Continued)

FOREIGN PATENT DOCUMENTS

CN 105430561 A 3/2016
CN 105554597 A 5/2016
(Continued)

OTHER PUBLICATIONS

English Translation of Chinese Search Report dated Aug. 6, 2019 for the related Chinese Patent Application No. 201780042712.1.
(Continued)

*Primary Examiner* — Amir H Etesam
(74) *Attorney, Agent, or Firm* — McDermott Will & Emery LLP

(57) ABSTRACT

A speaker device includes a housing that has a sound guide space having a vertically flattened shape, a first speaker disposed in the housing to be oriented toward a front of the housing, and a second speaker that is disposed in the housing and is oriented upward or downward to output sound into the sound guide space positioned at an internal upper part or an internal lower part of the housing. The sound guide space opens at an opening that is formed in vertically flattened
(Continued)

form in the housing, and the opening has a vertical height that is smaller than an aperture of the first speaker.

13 Claims, 6 Drawing Sheets

(51) Int. Cl.
*H04R 1/26* (2006.01)
*H04R 1/34* (2006.01)

(56) References Cited

U.S. PATENT DOCUMENTS

| | | | | |
|---|---|---|---|---|
| 2012/0294455 | A1 | 11/2012 | Ogawa et al. | |
| 2014/0146991 | A1 | 5/2014 | Chien | |
| 2014/0247959 | A1* | 9/2014 | Yamanaka | H04R 1/345 381/388 |
| 2015/0104051 | A1 | 4/2015 | Chien | |
| 2016/0192063 | A1 | 6/2016 | Lee et al. | |

FOREIGN PATENT DOCUMENTS

| | | | |
|---|---|---|---|
| EP | 1791389 | A1 | 5/2007 |
| EP | 2360938 | A1 | 8/2011 |
| JP | 2003-518345 | | 6/2003 |
| JP | 2009-100194 | | 5/2009 |
| JP | 2012-244442 | | 12/2012 |
| WO | 2001/015492 | | 3/2001 |
| WO | 2015/002518 | | 1/2015 |

OTHER PUBLICATIONS

International Search Report of PCT application No. PCT/JP2017/024475 dated Sep. 26, 2017.
The Extended European Search Report dated Mar. 14, 2019 for the related European Patent Application No. 17827480.9.
English Translation of Chinese Search Report dated Apr. 22, 2020 for the related Chinese Patent Application No. 201780042712.1.
Communication pursuant to Article 94(3) EPC dated Apr. 23, 2020 for the related European Patent Application No. 17827480.9.

* cited by examiner

SPEAKER DEVICE

CROSS-REFERENCE TO RELATED APPLICATIONS

This application is a U.S. national stage application of the PCT International Application No. PCT/JP2017/024475 filed on Jul. 4, 2017, which claims the benefit of foreign priority of Japanese patent application No. 2016-137182 filed on Jul. 11, 2016, the contents all of which are incorporated herein by reference.

TECHNICAL FIELD

The present disclosure relates to a speaker device.

BACKGROUND ART

A speaker device disclosed by PTL 1 is installed, as a member separate from a television set (hereinafter also referred to as "TV"), in a lower front position of the television set and is used as an audio output device of the television set. This speaker device includes a housing that is rectangular when its front is viewed from in front, and a plurality of speakers disposed at the front of the housing.

CITATION LIST

Patent Literature

PTL 1: Unexamined Japanese Patent Publication No. 2012-244442

SUMMARY

The present disclosure provides a speaker device that emits sounds forward and can achieve both size increase of an aperture of a speaker and suppressed height increase of a housing.

A speaker device according to one aspect of the present disclosure includes a housing that has a sound guide space having a vertically flattened shape, a first speaker disposed in the housing to be oriented toward a front of the housing, and a second speaker disposed in the housing, the second speaker being oriented upward or downward to output sound into the sound guide space that is positioned at an internal upper part or an internal lower part of the housing. The sound guide space opens at an opening that is formed in vertically flattened form in the housing, and the opening has a vertical height that is smaller than an aperture of the first speaker.

The speaker device of the present disclosure is a speaker device that emits sounds forward and can achieve both size increase of an aperture of the speaker and suppressed height increase of the housing.

DESCRIPTION OF EMBODIMENTS

Figure 1:
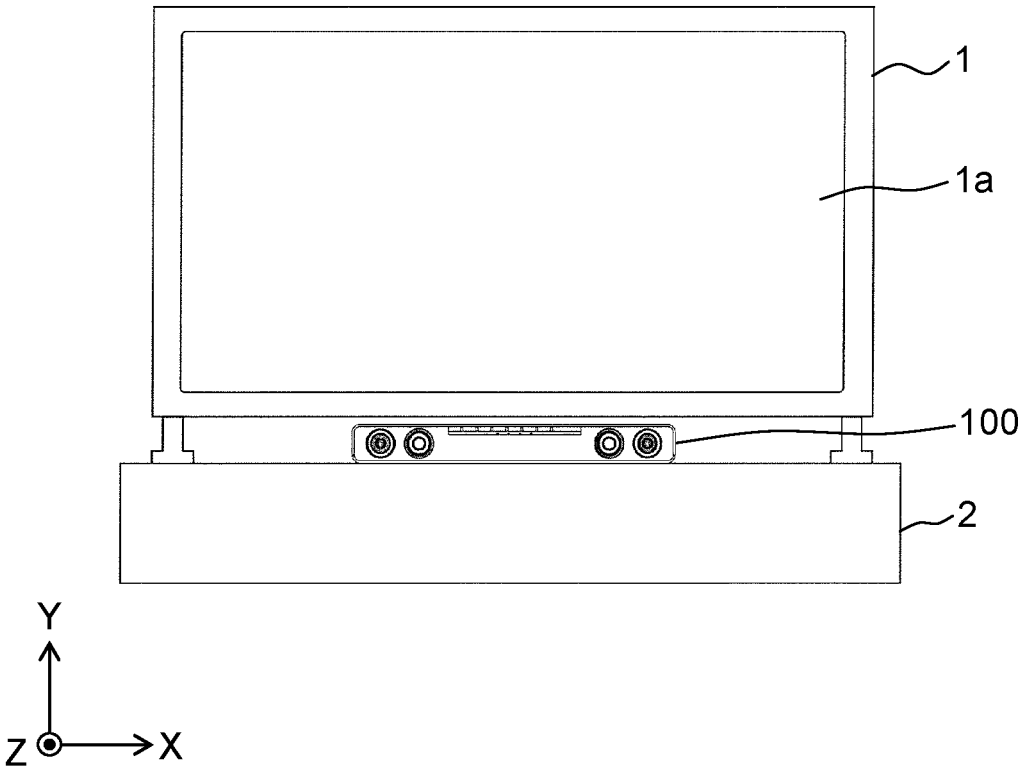
FIG. 1 is a front elevation schematically illustrating an example of installation of a speaker device according to a first exemplary embodiment.

Exemplary embodiments are hereinafter described in detail with reference to the drawings where appropriate. It is to be noted, however, that detailed descriptions that are more than necessary may be omitted. For example, detailed descriptions of already well-known matters and repeated descriptions of substantially the same structures may be omitted. This is for the purpose of preventing the following description from needlessly having redundancy, thereby facilitating understanding by those skilled in the art.

In the following description of the exemplary embodiments, an expression including "substantially", such as "substantially parallel" or "substantially orthogonal", may be used. For example, "substantially parallel" implies not only "completely parallel", but also "approximately (or virtually) parallel". "Substantially" here implies inclusion of a range that is not problematic in practical use. In other words, the expression including "substantially" implies allowance of a difference falling within the range that is not problematic in practical use.

It is to be noted that the accompanying drawings and the following description are provided for those skilled in the art to fully understand the present disclosure and are not intended to limit the subject matter as described in the claims.

The drawings are not necessarily exact illustrations, but schematic views in which emphasis, omission, and proportion adjustment are made as required for illustration of the present disclosure, and these drawings may have shapes, positional relationships, and proportions that differ from actual shapes, actual positional relationships, and actual proportions. In the drawings, substantially identical constituent elements have the same reference marks, and descriptions of those constituent elements may be omitted or simplified.

The exemplary embodiments of the present disclosure are described below with reference to FIGS. 1 to 6. Three axes, i.e., an X-axis, a Y-axis, and a Z-axis are shown in the drawings for use on an as needed basis in the following description of the exemplary embodiments. In these exemplary embodiments, for convenience' sake, a line parallel (substantially parallel) to a long side of television set 1 is taken as the X-axis, a line parallel (substantially parallel) to a short side of television set 1 is taken as the Y-axis, and a line orthogonal to both the X-axis and the Y-axis is taken as the Z-axis. As such, image display surface 1*a* of television set 1 is parallel (substantially parallel) to an X-Y plane in the following description. A line vertical to the X-Y plane, namely, the Y-axis is a line of gravity, and a direction in which gravity acts is taken as a negative direction of the Y-axis. Under normal conditions of use, television set 1 is mounted on television stand 2 that is installed on an installation surface (horizontal plane) parallel (substantially parallel) to an X-Z plane with image display surface 1*a* facing forward (in a positive direction of the Z-axis). It is to be noted that the installation surface on which television stand 2 is installed is not shown in the drawings. A television set side that faces a user (not illustrated) viewing television set 1 is taken as a "front" or "forward side", while a television set side opposite from the front is taken as a "rear". A direction from the rear to the front of television set 1 is taken as "forward" or the positive direction of the Z-axis. Relative remoteness from the installation surface in a positive direction of the Y-axis is taken as "upward", while relative proximity to the installation surface is taken as "downward". In the following description, there are also cases where the Y-axis is described as "heightwise" or "vertically", the X-axis is described as "horizontally" or a "left-right line", the Z-axis is described as "depthwise" or a "front-back line", and a plane parallel to the X-Z plane is described as "horizontal". It is to be noted that these lines are not absolute lines, but relative lines that are shown for convenience.

First Exemplary Embodiment

[1-1. Structure of Speaker Device]

With reference to the drawings, a description is hereinafter provided of structure of speaker device 100 according to the first exemplary embodiment.

FIG. 1 is a front elevation schematically illustrating an example of installation of speaker device 100 according to the first exemplary embodiment. FIG. 1 schematically illustrates how speaker device 100 is being installed on television stand 2 together with television set 1.

As illustrated in FIG. 1, speaker device 100 is formed as a member separate from television set 1 and is installed, together with television set 1, on television stand 2 that is used for mounting of television set 1. Specifically, speaker device 100 is installed on television stand 2 so that, for example, a front of speaker device 100 is positioned forwardly of image display surface 1*a* of television set 1 (in the positive direction of the Z-axis) below image display surface 1*a* (in the negative direction of the Y-axis) while having its orientation adjusted to be substantially parallel to image display surface 1*a*. In the following description, speaker device 100 is set in such a state and is installed on television stand 2 together with television set 1. Speaker device 100 is electrically connected to television set 1 and outputs sound of television set 1 upon receiving an audio signal output from television set 1.

Speaker device 100 has the outside shape of a substantially rectangular parallelepiped that is long along the left-right line (along the X-axis) and is vertically thin (along the Y-axis). Speaker device 100 may have such a vertical height (Y-axis dimension) as to fit in, for example, a space between image display surface 1*a* and television stand 2. However, the present disclosure is not limited to this structure at all. It is to be noted that speaker device 100 is formed to output sound in a forward direction (in the positive direction of the Z-axis) from image display surface 1*a*.

Figure 2:
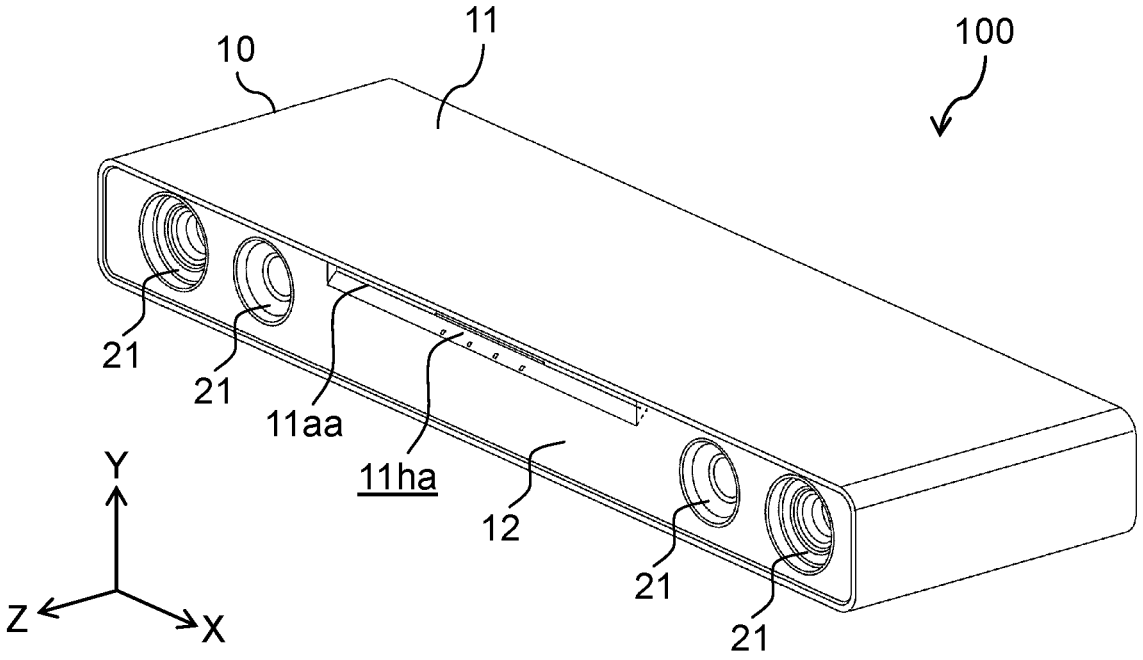
FIG. 2 is a perspective view schematically illustrating an example of external appearance of the speaker device according to the first exemplary embodiment.
Figure 3:
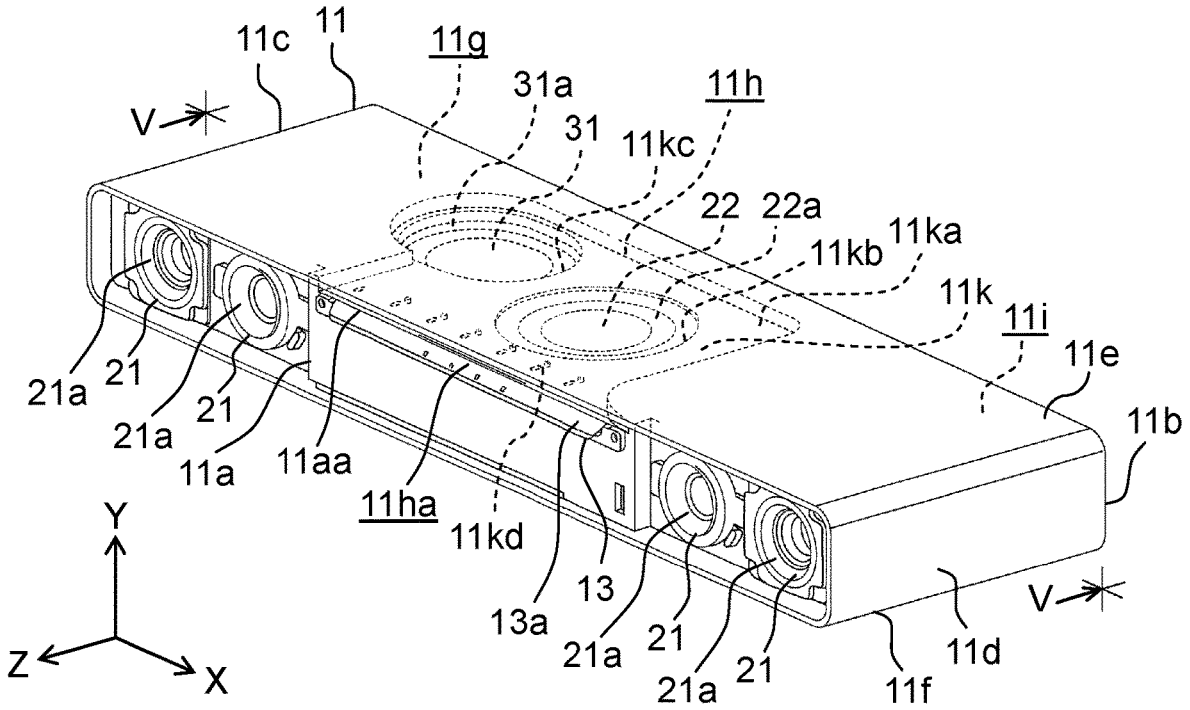
FIG. 3 is a perspective view schematically illustrating an example of a state in which a front panel is removed from the speaker device according to the first exemplary embodiment.
Figure 4:
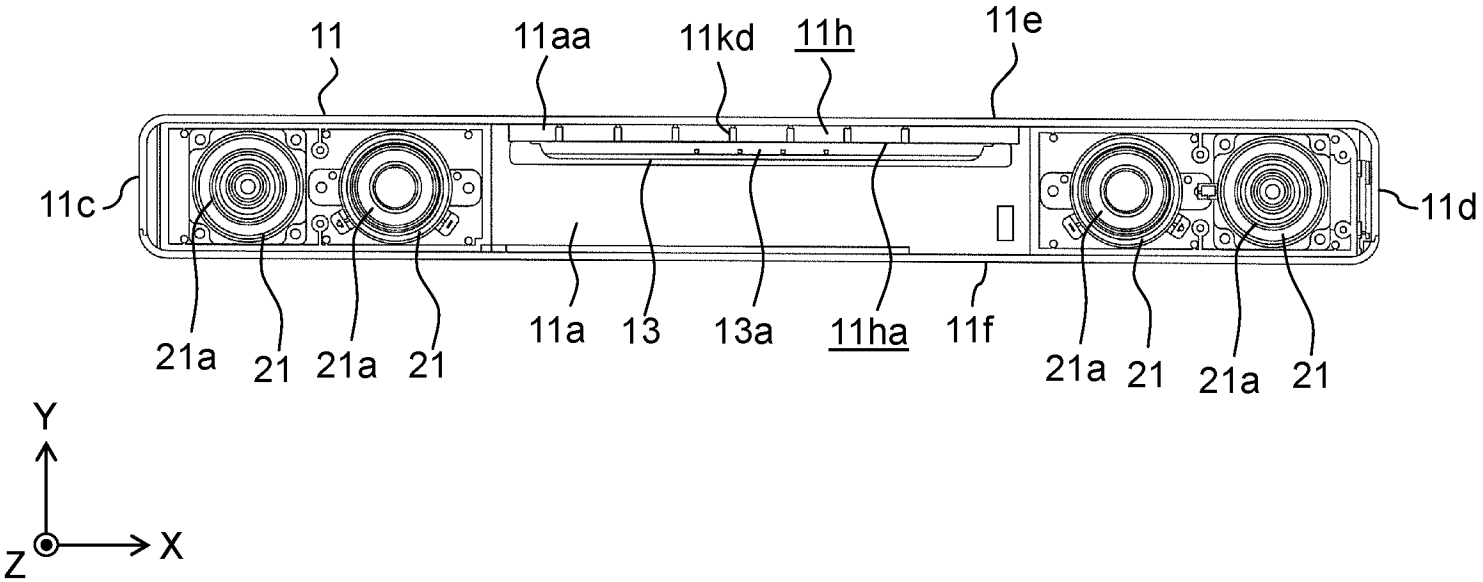
FIG. 4 is a front elevation schematically illustrating the example of the state in which the front panel is removed from the speaker device according to the first exemplary embodiment.

With reference to FIGS. 2 to 4, the structure of speaker device 100 is described next.

FIG. 2 is a perspective view schematically illustrating an example of external appearance of speaker device 100 according to the first exemplary embodiment.

FIG. 3 is a perspective view schematically illustrating an example of a state in which front panel 12 is removed from speaker device 100 according to the first exemplary embodiment.

FIG. 4 is a front elevation schematically illustrating the example of the state in which front panel 12 is removed from speaker device 100 according to the first exemplary embodiment.

As illustrated in FIG. 2, speaker device 100 includes housing 10 that has a vertical (Y-axis) side shorter than its other two sides. Housing 10 thus has the outside shape of a rectangular parallelepiped that is vertically flattened (along the Y-axis) in form. Housing 10 includes hollow main body 11 having the shape of a rectangular parallelepiped that is vertically flattened (along the Y-axis), and front panel 12 that has the shape of a flat plate to be mounted to a front of main body 11.

Figure 5:
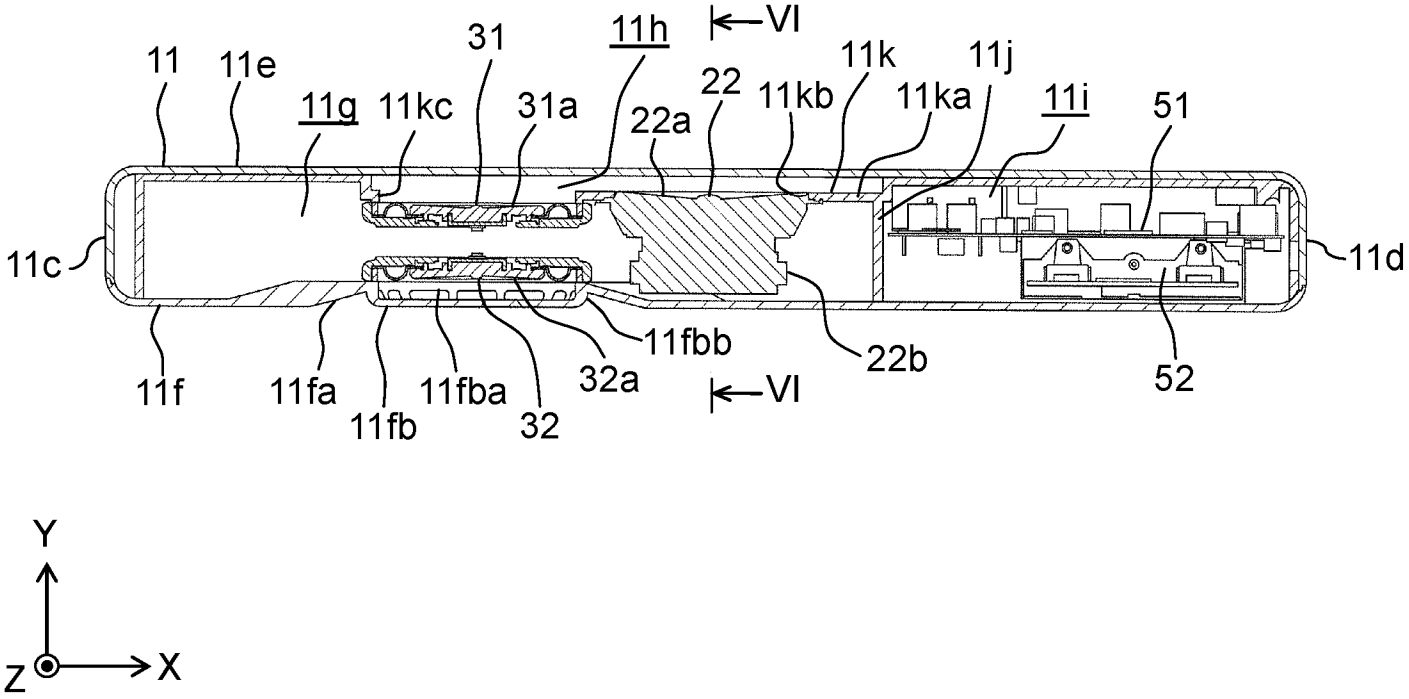
FIG. 5 is a sectional view schematically illustrating a structural example of the speaker device according to the first exemplary embodiment.
Figure 6:
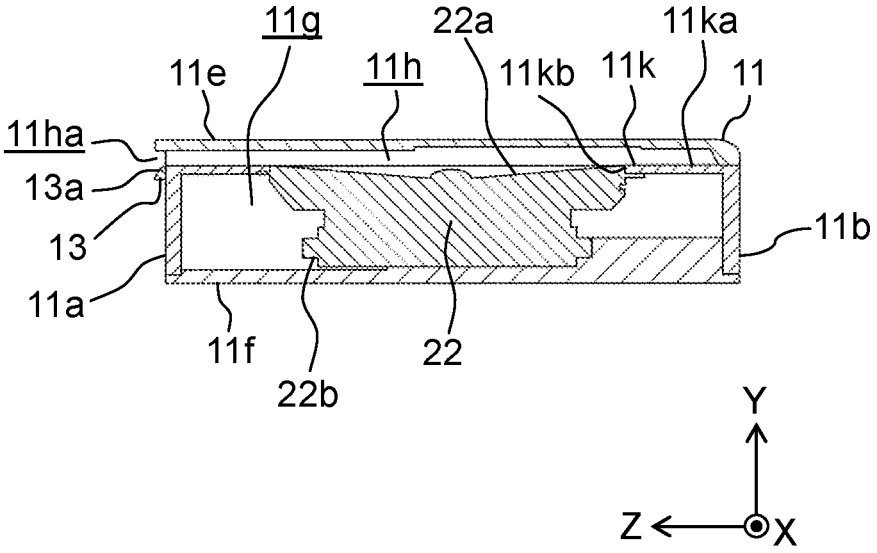
FIG. 6 is a sectional view schematically illustrating the structural example of the speaker device according to the first exemplary embodiment.

As illustrated in FIG. 3, main body 11 has front wall 11*a*, rear wall 11*b* (refer to FIG. 6), side wall 11*c* (refer to FIG. 5), side wall 11*d*, top wall 11*e*, and bottom wall 11*f* (refer to FIGS. 5 and 6). Housing 10 is made of a rigid material that can stably maintain the shape of housing 10. Given examples of the material used for making housing 10 include metal, resin, wood, glass, and fiber. It is to be noted that housing 10 is not limited to the above-described shape.

Front wall 11*a* and rear wall 11*b* each have the shape of a rectangular plate that has a horizontal (X-axis) length greater than its vertical (Y-axis) length. Front wall 11*a* and rear wall 11*b* are substantially identical in shape and have substantially the same dimensions. The respective horizontal (X-axis) lengths of front and rear walls 11*a* and 11*b* are each set substantially equal to a horizontal (X-axis) length of top wall 11*e*. Front wall 11*a* and rear wall 11*b* are disposed to face each other; front wall 11*a* is disposed at the front of main body 11 and rear wall 11*b* is disposed at a rear of main body 11. As such, when speaker device 100 is installed on television stand 2 together with television set 1, front wall 11*a* is disposed closer to image display surface 1*a* of television set 1, while rear wall 11*b* is disposed closer to the rear of television set 1. As illustrated in FIG. 3, front wall 11*a* is positioned closer to the rear of main body 11 (in a negative direction of the Z-axis) than respective front edges of side wall 11*c*, side wall 11*d*, top wall 11*e*, and bottom wall 11*f* are. This is for the purpose of enabling front panel 12 to be disposed in front of front wall 11*a* (in the positive direction of the Z-axis) as shown in FIG. 2.

Side walls 11*c* and 11*d* each have the shape of a rectangular plate that has a depthwise (Z-axis) length greater than its vertical (Y-axis) length. Side walls 11*c* and 11*d* are substantially identical in shape and have substantially the same dimensions. The respective vertical (Y-axis) lengths of side walls 11*c* and 11*d* are each set substantially equal to the vertical (Y-axis) length of each of front and rear walls 11*a* and 11*b*. Side walls 11*c* and 11*d* are disposed to face each other. When speaker device 100 is viewed from in front in the negative direction of the Z-axis, side wall 11*c* is disposed at a left side of main body 11, while side wall 11*d* is disposed at a right side of main body 11. As such, when speaker device 100 is installed on television stand 2 together with television set 1, side wall 11*c* is disposed leftwardly of a middle of television set 1, while side wall 11*d* is disposed rightwardly of the middle of television set 1. The respective depthwise (Z-axis) lengths of side walls 11*c* and 11*d* are each shorter than the horizontal (X-axis) length of top wall 11*e*. As such, when speaker device 100 is viewed from above in the negative direction of the Y-axis, main body 11 is rectangular, being long along the X-axis.

Top wall 11*e* and bottom wall 11*f* each have the shape of a rectangular plate that has a horizontal (X-axis) length greater than its depthwise (Z-axis) length. As described later, bottom wall 11*f* is formed with depression 11*fa* (refer to FIG.

5). Except for this point, top wall 11*e* and bottom wall 11*f* are substantially identical in shape and have substantially the same dimensions. The respective depthwise (Z-axis) lengths of top and bottom walls 11*e* and 11*f* are each set substantially equal to the depthwise (Z-axis) length of each of side walls 11*c* and 11*d*. The respective horizontal (X-axis) lengths of top and bottom walls 11*e* and 11*f* are each set substantially equal to the horizontal (X-axis) length of each of front and rear walls 11*a* and 11*b*. Top wall 11*e* and bottom wall 11*f* are disposed to face each other; top wall 11*e* is disposed at a top of main body 11 and bottom wall 11*f* is disposed at a bottom of main body 11. As such, when speaker device 100 is installed on television stand 2 together with television set 1, top wall 11*e* is disposed closer to television set 1, while bottom wall 11*f* is disposed closer to television stand 2.

By having such above structure, main body 11 is vertically flattened (along the Y-axis) in form. Rear wall 11*b*, side wall 11*c*, side wall 11*d*, top wall 11*e*, and bottom wall 11*f* form an exterior of housing 10, thus forming a design for speaker device 100.

Front wall 11*a* of main body 11 is formed with, at its upper central part, slit 11*aa* passing through front wall 11*a*. In the present exemplary embodiment, internal space 11*h* of main body 11 communicates with an exterior of main body 11 by way of slit 11*aa*. Slit 11*aa* has the shape of a slender rectangle that runs horizontally (along the X-axis) and has a horizontal (X-axis) length greater than its vertical height (Y-axis length). In other words, slit 11*aa* has a vertically flattened shape. Slit 11*aa* is an example of an opening that is formed in vertically flattened form in housing 10. In the present exemplary embodiment, the vertical height (Y-axis length) of slit 11*aa* is set smaller than an aperture (e.g. 4 cm) of first speaker 21. The vertical height of slit 11*aa* is, for example, about 1 cm. However, slit 11*aa* is not limited to this size at all.

A plurality of first speakers 21 are embedded in front wall 11*a*. The plurality of first speakers 21 are arranged in a horizontal line (along the X-axis) with their sound output directions being forward so as to output sounds forward. In other words, housing 10 has the plurality of speakers 21 that are arranged to be oriented forward (in the positive direction of the Z-axis) in the present exemplary embodiment. In the present exemplary embodiment, speaker device 100 includes four first speakers 21, two of which line up horizontally (along the X-axis) on a left side of slit 11*aa* while the other two line up horizontally (along the X-axis) on a right side of slit 11*aa*. It is to be noted that instead of having first speakers 21 embedded in front wall 11*a*, speaker device 100 may be formed so that the horizontal (X-axis) length of front wall 11*a* is shorter than the horizontal (X-axis) length of top wall 11*e* to allow first speakers 21 to be arranged between front wall 11*a* and side wall 11*c* as well as between front wall 11*a* and side wall 11*d*.

First speaker 21 is, for example, a small-size full-range speaker with an aperture that is about 4 cm in diameter. First speaker 21 has such a frequency characteristic as to suitably enable reproduction of sound in a specified frequency band. The specified frequency band ranges, for example, from 100 Hz to nearly 50 kHz or from 100 Hz to over 50 kHz. First speaker 21, however, is not limited to this frequency characteristic at all. First speaker 21 may be, for example, a tweeter that can suitably reproduce sound in a specified high-range frequency band that ranges, for example, from 1 kHz to nearly 100 kHz or from 2 kHz to over 100 kHz.

The frequency characteristic of each of two first speakers 21 that are disposed relatively closer to slit 11*aa* may be different from the frequency characteristic of each of two first speakers 21 that are disposed relatively farther from slit 11*aa*. In this case, it is not two first speakers 21 disposed relatively closer to slit 11*aa*, but those two first speakers 21 disposed relatively farther from slit 11*aa* that may be suitable to output high-range sounds.

FIG. 5 is a sectional view schematically illustrating a structural example of speaker device 100 according to the first exemplary embodiment. The FIG. 5 sectional view of speaker device 100 is taken along line V-V of FIG. 3.

FIG. 6 is a sectional view schematically illustrating the structural example of speaker device 100 according to the first exemplary embodiment. The FIG. 6 sectional view of speaker device 100 is taken along line VI-VI of FIG. 5.

As shown in FIGS. 3 to 6, three internal spaces 11*g*, 11*h*, and 11*i* are formed in mutually divided relationship inside main body 11 of housing 10.

As illustrated in FIG. 5, internal space 11*g* and internal space 11*i* are separated from each other by partition 11*j* that is provided vertically (along the Y-axis) to be upright in main body 11, and internal spaces 11*g* and 11*i* adjoin horizontally (along the X-axis) via partition 11*j*. In other words, internal spaces 11*g* and 11*i* are divided from each other by partition 11*j* without communicating with each other. Similarly, internal space 11*h* and internal space 11*i* are divided from each other without communicating with each other.

Internal space 11*h* and internal space 11*g* are separated from each other by partition 11*k* that is shaped into a bottomed tube in vertically flattened form (along the Y-axis) as illustrated in FIG. 3 (see a part indicated by broken lines) and FIG. 5. Partition 11*k* has planarly extending floor partition 11*ka* that is provided directly under top wall 11*e* (in the negative direction of the Y-axis) inside main body 11 to be substantially parallel to top wall 11*e* in spaced relation to top wall 11*e*. As such, internal spaces 11*h* and 11*g* adjoin vertically (along the Y-axis) via floor partition 11*ka* with internal space 11*h* being disposed above internal space 11*g* (in the positive direction of the Y-axis).

Together with top wall 11*e*, floor partition 11*ka* surrounds an internal part of main body 11, so that internal space 11*h* is formed. Floor partition 11*ka* is formed with two circular openings 11*kb* and 11*kc*, and internal space 11*h* communicates with internal space 11*g* via openings 11*kb* and 11*kc*. It is to be noted that the openings formed in floor partition 11*ka* are not limited to two in number. There may be one opening or not less than three openings to be formed in floor partition 11*ka*.

A vertical space (Y-axis clearance) between floor partition 11*ka* and top wall 11*e* is set substantially equal to the vertical height (Y-axis length) of slit 11*aa*. As such, a vertical height (Y-axis dimension) of internal space 11*h* is substantially equal to the vertical height (Y-axis length) of slit 11*aa*, and internal space 11*h* stretches (depthwise or along the Z-axis) along top wall 11*e* from front wall 11*a* to rear wall 11*b* while maintaining its height. A width (X-axis dimension) of internal space 11*h* may be substantially equal to the width (X-axis dimension) of slit 11*aa*. Moreover, internal space 11*h* may partly have a width that is greater than the width of slit 11*aa*. Internal space 11*h* communicates with the exterior of main body 11 via slit 11*aa*. Internal space 11*h* thus forms a sound guide space that as a passage, guides sound in a direction from rear wall 11*b* to front wall 11*a*.

As described above, internal space 11*h*, which is the sound guide space, is formed to include top wall 11*e* and floor partition 11*ka* of housing 10 and extends (depthwise or along the Z-axis) from front wall 11*a* to rear wall 11*b* of housing 10 while having the vertical height substantially equal to the vertical height (e.g. 1 cm) of slit 11*aa*, which is the opening. In other words, housing 10 of speaker device 100 has the sound guide space (internal space 11*h*) having a vertically flattened shape, and this sound guide space opens onto the exterior of main body 11 at the opening (slit 11*aa*) that is formed in vertically flattened form in housing 10. Internal space 11*h*, which is the sound guide space, has, at least near slit 11*aa*, a passage section of the same shape as slit 11*aa*. It is to be noted that in the present disclosure, the shape of internal space 11*h*, which is the sound guide space, is not limited to the above-described shape at all.

In the present exemplary embodiment, slit 11*aa* is formed to have the width (X-axis length) that is greater a diameter of opening 11*kb*. Opening 11*kb* is disposed midway between side walls 11*c* and 11*d* to be aligned with slit 11*aa* behind slit 11*aa* when speaker device 100 is viewed from in front in a depthwise direction (negative direction of the Z-axis) that is substantially parallel to the horizontal plane (X-Z plane). Opening 11*kb* is thus included in an area (extending from slit 11*aa* in the negative direction of the Z-axis) behind slit 11*aa* when speaker device 100 is viewed from in front in the Z-axis negative direction that is substantially parallel to the horizontal plane (X-Z plane). In other words, opening 11*kb* is disposed at a position to overlap slit 11*aa* (in the rear of slit 11*aa*) when the front of speaker device 100 is viewed from in front in the direction substantially parallel to the horizontal plane (X-Z plane). It is to be noted that "midway" mentioned above is a position of opening 11*kb* in the rear of slit 11*aa*.

Opening 11*kc* is disposed next to opening 11*kb* (e.g. on an X-axis negative side of opening 11*kb*, namely, between opening 11*kb* and side wall 11*c*).

As illustrated in FIGS. 3 and 4, a plurality of guides 11*kd* are formed on floor partition 11*ka* near slit 11*aa* in internal space 11*h*, which is the sound guide space. Guides 11*kd* are belt-shaped projections that are long depthwise (along the Z-axis). The plurality of guides 11*kd* are arranged in a horizontal line (along the X-axis) in mutually spaced relationship (substantially at equal intervals) to be substantially parallel to one another. Guides 11*kd* are members that give directivity to sound that is emitted toward the exterior of main body 11 through the sound guide space (internal space 11*h*) and slit 11*aa*.

As illustrated in FIG. 4, front wall 11*a* of main body 11 is mounted with elongated directional member 13 having a length substantially equal to the (X-axis) width of slit 11*aa*. Directional member 13 is disposed to directly underlie slit 11*aa* while being long horizontally (along the X-axis). As such, directional member 13 directly underlying slit 11*aa* extends substantially throughout the whole (X-axis) width of slit 11*aa*.

As illustrated in FIGS. 4 and 6, directional member 13 has, as an upper side of directional member 13 (in the positive direction of the Y-axis), directional surface 13*a* that slopes diagonally to the lower front (in the positive direction of the Z-axis as well as in the negative direction of the Y-axis) from a bottom (lower side) of slit 11*aa*. Directional surface 13*a* forms diffusive lead-through part 11*ha* with top wall 11*e*. Diffusive lead-through part 11*ha* is a sound passage that diffuses forward (in the positive direction of the Z-axis) and downward (in the negative direction of the Y-axis) air released from the sound guide space (internal space 11*h*) through slit 11*aa*. Diffusive lead-through part 11*ha* is an example of a divergent opening.

Diffusive lead-through part 11*ha* is shaped by top wall 11*e* and directional surface 13*a* to spread vertically (along the Y-axis) while heading forward (in the positive direction of the Z-axis) (or to broaden toward its end). Accordingly, when sound is emitted from the sound guide space (internal space 11*h*) that has, for example, such an exit, the emitted sound is diffused forwardly of slit 11*aa* (in the positive direction of the Z-axis) between a substantially horizontal line and a downward line (negative direction of the Y-axis).

It is to be noted that directional surface 13*a* of the present exemplary embodiment has, as illustrated in FIG. 6, the form of a convex surface that gently curves in the sloping direction. Thus, a relatively increased range of diffusion can be achieved for air that is released from the sound guide space (internal space 11*h*). However, the present disclosure is not limited to this structural example. Directional surface 13*a* may be flat. While directional member 13 shown in the structural example of the present exemplary embodiment is formed separately from main body 11, directional member 13 may be formed integrally with main body 11.

Front panel 12 mounted to the front (positioned in the positive direction of the Z-axis) of main body 11 is a member covering a front surface (positioned in the positive direction of the Z-axis) of front wall 11*a*. However, front panel 12 exteriorly exposes, as illustrated in FIG. 2, the open end of diffusive lead-through part 11*ha*, which is formed by directional surface 13*a* and top wall 11*e*, and respective front surfaces (from which sounds are emitted) of four first speakers 21. Front panel 12 forms the exterior of housing 10 to form the design for speaker device 100.

As illustrated in FIGS. 3, 5, and 6, one second speaker 22 is fit into opening 11*kb* provided in floor partition 11*ka*, while one first passive radiator 31 is fit into opening 11*kc* provided in floor partition 11*ka*. In this way, openings 11*kb* and 11*kc* are closed, so that the mutual communication between the sound guide space (internal space 11*h*) and internal space 11*g* is cut off. Thus, internal space 11*g* becomes a closed space, and the sound guide space (internal space 11*h*) becomes a closed space if slit 11*aa* is excluded.

As illustrated in FIGS. 5 and 6, second speaker 22 disposed in opening 11*kb* has its diaphragm 22*a* exposed to the sound guide space (internal space 11*h*). Second speaker 22 is installed in a preset direction to output sound toward top wall 11*e* of housing 10. In other words, second speaker 22 is disposed in housing 10 with its sound output direction being upward (the positive direction of the Y-axis) so as to output sound into the sound guide space (internal space 11*h*) that is positioned above second speaker 22 (in the positive direction of the Y-axis).

Compared with first speaker 21, second speaker 22 is a speaker that can suitably reproduce low-range sound. Second speaker 22 is, for example, a subwoofer having a larger aperture (e.g. about 8 cm in diameter) than that of first speaker 21. Second speaker 22 has such a frequency characteristic as to suitably enable reproduction of sound in a specified low-range frequency band. The specified low-range frequency band ranges, for example, from 20 Hz to 100 Hz or from 20 Hz to 200 Hz. However, second speaker 22 is not limited to this frequency characteristic at all. Second speaker 22 may be, for example, a woofer that can suitably reproduce sound in a specified low- to mid-range frequency band that ranges, for example, from 20 Hz to 2000 Hz.

First speakers 21 each include cone-shaped diaphragm 21*a* that produces sound, and a drive unit (not shown) that drives diaphragm 21*a*. Second speaker 22 includes cone-shaped diaphragm 22*a* that produces sound, and drive unit 22*b* that drives diaphragm 22*a*.

On the other hand, first passive radiator 31 includes diaphragm 31*a* that is, for example, cone-shaped but does not include a drive unit that drives diaphragm 31*a*.

As illustrated in FIG. 5, first passive radiator 31 disposed in opening 11*kc* has its diaphragm 31*a* exposed to the sound guide space (internal space 11*h*). First passive radiator 31 is installed in a preset direction so that diaphragm 31*a* faces top wall 11*e* of housing 10. In other words, first passive radiator 31 is disposed in housing 10 with an axis of cone-shaped diaphragm 31*a* in substantially parallel relation to an axis of cone-shaped diaphragm 22*a* of second speaker 22.

First passive radiator 31 emits sound toward top wall 11*e* by allowing diaphragm 31*a* to resonate with air in internal space 11*g*. It is to be noted that the air in internal space 11*g* resonates with second speaker 22 when diaphragm 22*a* of second speaker 22 is vibrated.

First passive radiator 31 has an aperture that is similar to the aperture of second speaker 22, and a frequency characteristic that is similar to the frequency characteristic of second speaker 22. However, with regard to the structure and the installation position of first passive radiator 31, the above-described structural example is not at all limiting. For example, first passive radiator 31 may be disposed at any of front wall 11*a*, rear wall 11*b*, and side wall 11*c* or may have an aperture different from the aperture of second speaker 22.

As illustrated in FIG. 5, second speaker 22 and first passive radiator 31 share internal space 11*g* as their rear space. It is to be noted here that internal space 11*g* is an example of a first space. In other words, second speaker 22 and first passive radiator 31 have, as their common rear space, the first space (internal space 11*g*) that is separate from (or divided from the sound guide space without communicating with) the sound guide space (internal space 11*h*) in housing 10. The rear space for second speaker 22 is a space positioned (in the Y-axis negative direction) opposite to the direction (Y-axis positive direction) in which second speaker 22 outputs sound. The rear space for first passive radiator 31 is a space positioned (in the Y-axis negative direction) opposite to the direction (Y-axis positive direction) in which first passive radiator 31 outputs sound.

Internal space 11*g* forms a resonant space between second speaker 22 and first passive radiator 31. As such, first passive radiator 31 resonates with internal space 11*g* resonating with vibration of diaphragm 22*a* of second speaker 22. Because of vibration effected by this resonance, sound is emitted into the sound guide space (internal space 11*h*) that is positioned above first passive radiator 31 (in the positive direction of the Y-axis).

As illustrated in FIG. 5, bottom wall 11*f* of main body 11 of housing 10 is recessed in a direction from bottom wall 11*f* to top wall 11*e* (in the positive direction of the Y-axis) to have depression 11*fa* that has the shape of a circular truncated cone. One second passive radiator 32 is embedded at a bottom of depression 11*fa*.

Second passive radiator 32 is positioned above (on a Y-axis positive side of) bottom wall 11*f* inside internal space 11*g* and has its diaphragm 32*a* that is exposed at the bottom of depression 11*fa* to face downward (in the negative direction of the Y-axis) from bottom wall 11*f*. Second passive radiator 32 is disposed at the bottom of depression 11*fa* with its sound output direction being downward (the negative direction of the Y-axis) so as to output sound downward (in the negative direction of the Y-axis) from bottom wall 11*f* of housing 10.

The bottom of depression 11*fa* is positioned so that second passive radiator 32 does not interfere with a lower part of second speaker 22. In other words, depression 11*fa* is positioned so that second passive radiator 32 disposed at the bottom of depression 11*fa* does not overlap second speaker 22 (or is shifted sideward from second speaker 22) when housing 10 is viewed from above in the negative direction of the Y-axis (or from below in the positive direction of the Y-axis). In this way, vertical height (Y-axis dimension) increase of housing 10 including depression 11*fa* and second passive radiator 32 can be suppressed.

As illustrated in FIG. 5, second passive radiator 32 of the present exemplary embodiment is disposed directly underneath first passive radiator 31 (in a position vertically opposite from first passive radiator 31 (along the Y-axis)). In other words, second passive radiator 32 is positioned to overlap first passive radiator 31 when housing 10 is viewed from above in the negative direction of the Y-axis (or from below in the positive direction of the Y-axis).

In the present exemplary embodiment, second passive radiator 32 has substantially the same structure as first passive radiator 31. As described above, second passive radiator 32 is disposed in housing 10 with its sound output direction being vertically opposite from first passive radiator 31 (along the Y-axis). Inside housing 10, second passive radiator 32 and first passive radiator 31 are disposed, as described above, substantially in the same position on the front-back line (the Z-axis) and the left-right line (X-axis) (or substantially in the same position on the horizontal plane or X-Z plane). As such, a vibration direction of diaphragm 31*a* of first passive radiator 31 and a vibration direction of diaphragm 32*a* of second passive radiator 32 have vertical (Y-axis) linearity.

Second speaker 22, first passive radiator 31, and second passive radiator 32 share internal space 11*g* as their rear space. It is to be noted here that internal space 11*g* is the example of the first space. In other words, second speaker 22, first passive radiator 31, and second passive radiator 32 have, as their common rear space, the first space (internal space 11*g*) that is separate from (or divided from the sound guide space without communicating with) the sound guide space (internal space 11*h*) in housing 10. The rear space for second passive radiator 32 is a space positioned (in the Y-axis positive direction) opposite to the direction (Y-axis negative direction) in which second passive radiator 32 outputs sound. As such, internal space 11*g* forms the resonant space among second speaker 22, first passive radiator 31, and second passive radiator 32.

As illustrated in FIG. 5, cover 11*fb* having the shape of a bottomed flat cylinder is provided in depression 11*fa* of bottom wall 11*f* to cover second passive radiator 32 from below (from a Y-axis negative side of second passive radiator 32) in spaced relation to second passive radiator 32. Cover 11*fb* formed does not project downward (in the negative direction of the Y-axis) from bottom wall 11*f* (a Y-axis negative side of bottom wall 11*f*) where depression 11*fa* is surrounded. Thus, speaker device 100 can be mounted stably on television stand 2. Cover 11*fb* may be formed as a member separate from bottom wall 11*f* or may be formed integrally with bottom wall 11*f*.

Cylindrical side part 11*fbb* of cover 11*fb* is formed with a plurality of openings 11*fba*. Second passive radiator 32 emits sound toward cover 11*fb* by allowing diaphragm 32*a* to resonate with the air in internal space 11*g*. A portion of the sound emitted from second passive radiator 32 changes its travelling direction by striking against cover 11*fb* and diffuses out of housing 10 through the plurality of openings 11*fba*. While the plurality of openings 11*fba* are arranged throughout a periphery of side part 11*fbb* of cover 11*fb* in the present exemplary embodiment, the present disclosure is not limited to this structure. To give directivity to sound that is emitted from cover 11*fb*, the plurality of openings 11*fba* may be disposed, for example, in a portion (e.g. only in a front-wall-end portion) of side part 11*fbb* of cover 11*fb*. It is to be noted that with regard to the structure and the installation position of second passive radiator 32, the above-described structural example is not at all limiting. For example, second passive radiator 32 may be disposed at any of front wall 11*a*, rear wall 11*b*, and side wall 11*c* or may be disposed in a position that is not opposite from first passive radiator 31. Second passive radiator 32 may have another alternative structure that is different from first passive radiator 31.

With speaker device 100 having such structure as described above, housing 10 can be formed to have its vertical height (Y-axis dimension) reduced (to about 5 cm, for example) while including first speakers 21 each having the aperture of about 4 cm in diameter at front wall 11*a*, second speaker 22 and first passive radiator 31 each having the aperture that is about 8 cm in diameter at floor partition 11*ka*, and second passive radiator 32 having the aperture that is about 8 cm in diameter at bottom wall 11*f*.

Generally, a speaker and a passive radiator respectively have significantly small dimensions in their sound emitting directions with respect to their apertures. In speaker device 100, second speaker 22, first passive radiator 31, and second passive radiator 32 are disposed, as described above, with each of their sound output directions being either upward or downward (either the positive or negative direction of the Y-axis), thereby significantly reducing a vertical (Y-axis) area that these members occupy inside housing 10.

As illustrated in FIG. 5, provided in internal space 11*i* are drive circuit 51 that drives first speakers 21 and second speaker 22, and connector 52 that electrically interconnects drive circuit 51 and a device (such as television set 1) installed to be external to speaker device 100. It is to be noted here that internal space 11*i* is an example of a second space. In other words, speaker device 100 includes drive circuit 51, which drives first speakers 21 and second speaker 22, in the second space (internal space 110 that is separate from (or divided from the sound guide space without communicating with) the sound guide space (internal space 11*h*) in housing 10. The above-mentioned second space (internal space 110 that is formed is also separate from (or divided from the first space without communicating with) the first space (internal space 11*g*) that second speaker 22 has as its rear space in housing 10. Thus, drive circuit 51 for first speakers 21 and second speaker 22 of speaker device 100 is disposed in the second space (internal space 110 that is divided from the spaces (internal space 11*h* functioning as the sound guide space, and internal space 11*g* functioning as the resonant space) in which air vibration is effected by sound. In this way, drive circuit 51 can have a reduced effect on sound (air vibration effected by sound) in speaker device 100. Deterioration of an electric circuit such as drive circuit 51 can be advanced by continuous application of vibration effected by sound and others. In speaker device 100, however, drive circuit 51 is disposed in the second space (internal space 11*i*) where drive circuit 51 is less susceptible to direct air vibration effected by sound, so that such deterioration can be suppressed for drive circuit 51. Connector 52 is electrically connected to drive circuit 51. By being physically connected, via an electrical signal transmission cable or the like, to an electrical signal output connector of the device (such as television set 1) external to speaker device 100, connector 52 electrically interconnects drive circuit 51 and the device (such as television set 1) external to speaker device 100. In this way, an electrical audio signal transmitted from the device (such as television set 1) external to speaker device 100 is transmitted to drive circuit 51. Drive circuit 51 includes an amplifier that amplifies electrical audio signals in order to amplify an electrical signal that drive circuit 51 receives from the device (such as television set 1) external to speaker device 100 for output to first speakers 21 and second speaker 22. It is to be noted that the present disclosure is not limited to the structural example having drive circuit 51 in internal space 11*i*. Drive circuit 51 may be provided, for example, in a unit that is installed to be external to housing 10 or in a device different from speaker device 100.

[1-2. Operation of Speaker Device]

A description is hereinafter provided of operation of speaker device 100 according to the first exemplary embodiment.

Drive circuit 51 in housing 10 of speaker device 100 receives an electrical audio signal that is transmitted via connector 52 from the device (such as television set 1) external to speaker device 100, amplifies the electrical signal and outputs an amplified electrical signal to first speakers 21 and second speaker 22.

According to the input electrical signal from drive circuit 51, first speakers 21 have their diaphragms 21*a* driven, thus emitting sounds corresponding to the electrical signal forward (in the positive direction of the Z-axis).

According to the input electrical signal from drive circuit 51, second speaker 22 has its diaphragm 22*a* driven, thus emitting sound corresponding to the electrical signal toward top wall 11*e* of housing 10. A portion of the sound emitted from second speaker 22 changes its travelling direction by striking against top wall 11*e* and travels through the sound guide space (internal space 11*h*) toward slit 11*aa*. In the course of its travel, the sound is given directivity by the plurality of guides 11*kd*. When emitted out of housing 10 through slit 11*aa*, the sound given the directivity by guides 11*kd* is diffused forwardly of slit 11*aa* (in the positive direction of the Z-axis) between the substantially horizontal line and the downward line (negative direction of the Y-axis) by diffusive lead-through part 11*ha*.

With diaphragm 22*a* of second speaker 22 vibrating according to the input electrical signal from drive circuit 51, the air in space 11*g* of housing 10 resonates. Accordingly, diaphragm 31*a* of first passive radiator 31 and diaphragm 32*a* of second passive radiator 32 vibrate. With diaphragm 31*a* vibrating, first passive radiator 31 emits sound toward top wall 11*e* of housing 10 in the sound guide space (internal space 11*h*). In the sound guide space (internal space 11*h*), the sound emitted from first passive radiator 31 reinforces the sound (particularly in a lower range) emitted from second speaker 22. With diaphragm 32*a* vibrating, second passive radiator 32 emits sound toward a side periphery of second passive radiator 32 (along a line parallel to the X-Z plane). The sound emitted from second passive radiator 32 also reinforces the sound (particularly in the lower range) emitted from second speaker 22.

With these operations in speaker device 100, the second speaker's sound that has excellent low-range sound quality as a result of having its lower range reinforced by first passive radiator 31 is emitted from slit 11*aa* (diffusive lead-through part 11*ha*) that is in a front central position of housing 10, while the sounds of first speakers 21 are emitted from both the sides of slit 11*aa*. First speakers 21 each have the relatively smaller aperture, thus being suitable for reproduction of mid- to high-range sounds rather than low-range sound. And yet speaker device 100 can enhance its low-range sound reproduction capability because of the sound emitted from slit 11*aa*.

The higher the sound range (i.e. the higher the frequency), the stronger the directivity of sound is. On the other hand, the lower the sound range (i.e. the lower the frequency), the weaker the directivity of sound is. In consideration of this property of sound, first speakers 21 of speaker device 100 are disposed to be evenly divided between the left and right sides (along the X-axis) of slit 11*aa* (so that the left and right sides of slit 11*aa* equally have two first speakers 21 each in the present exemplary embodiment). Accordingly, various sounds are output from speaker device 100 with the low-range sound of relatively weak directivity that is output from second speaker 22 being sandwiched by the high-range sounds of relatively strong directivity that are output from first speakers 21. Thus, speaker device 100 can suppress occurrence of such a phenomenon that a sound image covering from the low-range sound that is emitted from second speaker 22 through slit 11*aa* to the high-range sounds that are emitted from first speakers 21 is displaced and drawn toward one of the left and right sides of slit 11*aa*. In other words, speaker device 100 can suppress the occurrence of the sound image displacement with regard to all sounds in its reproducible frequency bands.

In speaker device 100, first passive radiator 31 is disposed at an internal upper position of housing 10 (in the positive direction of the Y-axis), while second passive radiator 32 is disposed at an internal lower position of housing 10 (in the negative direction of the Y-axis). Diaphragm 31*a* of first passive radiator 31 and diaphragm 32*a* of second passive radiator 32 vibrate in the vertically opposite directions (along the Y-axis). Thus, in internal space 11*g* of housing 10, air pulsations in vertically opposite directions are canceled by first passive radiator 31 and second passive radiator 32. Consequently, speaker device 100 can achieve reduced vertical (Y-axis) vibration of housing 10.

It is to be noted that top wall 11*e* of housing 10 may be made of a material (such as resin) that can be vibrated by sound of second speaker 22. In the case of this structure, top wall 11*e* produces sound by being vibrated by the sound of second speaker 22, so that sound that is output out of housing 10 through the sound guide space (internal space 11*h*) can be reinforced in the lower range.

In the structural example of speaker device 100 that is described in the present exemplary embodiment, the sound guide space (internal space 11*h*) is provided at an internal upper part of housing 10 (in the positive direction of the Y-axis), and second speaker 22 is disposed in housing 10 to be oriented upward (in the positive direction of the Y-axis). However, it is to be noted that the present disclosure is not limited to this structural example at all. In speaker device 100, the sound guide space (internal space 11*h*) may be provided, for example, at an internal lower part of housing 10 (in the negative direction of the Y-axis), and second speaker 22 may be disposed in housing 10 to be oriented downward (in the negative direction of the Y-axis). In other words, in speaker device 100, the sound guide space (internal space 11*h*) and second speaker 22 may be vertically inverted with respect to the structure shown in FIG. 5.

In the structural example of speaker device 100 that is described in the present exemplary embodiment, floor partition 11*ka* has two openings 11*kb* and 11*kc*. However, it is to be noted that the present disclosure is not limited to this structural example at all. Floor partition 11*ka* may have one opening or not less than three openings. In cases where floor partition 11*ka* has one opening, second speaker 22 is disposed in that opening. In cases where floor partition 11*ka* has not less than three openings, second speaker 22, first passive radiator 31, or another speaker may be disposed in each of the third and following openings.

[1-3. Effects and Others]

As described above, the speaker device according to the present exemplary embodiment includes a housing that has a sound guide space having a vertically flattened shape, a first speaker disposed in the housing to be oriented toward a front of the housing, and a second speaker that is disposed in the housing and is oriented upward or downward to output sound into the sound guide space positioned at an internal upper part or an internal lower part of the housing. The sound guide space opens at an opening that is formed in vertically flattened form in the housing, and the opening has a vertical height that is smaller than an aperture of the first speaker.

Alternatively, a speaker device according to the present exemplary embodiment includes a housing that has a sound guide space having a vertically flattened shape, a first speaker disposed in the housing to be oriented toward a front of the housing, and a second speaker that is disposed in the housing and is oriented upward to output sound into the sound guide space positioned at an internal upper part of the housing. The sound guide space opens at an opening that is formed in vertically flattened form in the housing, and the opening has a vertical height that is smaller than an aperture of the first speaker.

It is to be noted that speaker device 100 is an example of the speaker device. Internal space 11*h* is an example of the sound guide space having the vertically flattened shape. Housing 10 is an example of the housing. First speaker 21 is an example of the first speaker. Second speaker 22 is an example of the second speaker. Slit 11*aa* is the example of the opening that is formed in vertically flattened form in the housing.

In the example shown in the first exemplary embodiment, for example, speaker device 100 includes housing 10 that has the sound guide space (internal space 11*h*) having the vertically flattened shape, first speakers 21 disposed in housing 10 to be oriented toward the front of housing 10, and second speaker 22 that is disposed in housing 10 and is oriented upward to output sound into the sound guide space (internal space 11*h*) positioned at the internal upper part of housing 10. The sound guide space (internal space 11*h*) opens at slit 11*aa* that is formed in vertically flattened form in housing 10, and slit 11*aa* has the vertical height (e.g. 1 cm) that is smaller than the aperture (e.g. 4 cm) of each of the first speakers 21.

In the speaker device, the sound guide space may extend from a front wall of the housing to a rear wall of the housing while the sound guide space having a vertical height substantially equal to the vertical height of the opening.

It is to be noted that front wall 11*a* is an example of the front wall. Rear wall 11*b* is an example of the rear wall.

In the example shown in the first exemplary embodiment, for example, the sound guide space (internal space 11*h*) of speaker device 100 extends (depthwise or along the Z-axis) from front wall 11*a* to rear wall 11*b* of housing 10 while the sound guide space (internal space 11*h*) having the vertical height (e.g. 1 cm) substantially equal to the vertical height of slit 11*aa*.

In the speaker device, the housing may include a floor partition that extends in substantially parallel relation to a top wall of the housing while the floor partition being in spaced relation to the top wall. The sound guide space may be formed to include the top wall and the floor partition of the housing.

It is to be noted that top wall 11*e* is an example of the top wall. Floor partition 11*ka* is an example of the floor partition.

In the example shown in the first exemplary embodiment, for example, housing 10 of speaker device 100 includes floor partition 11*ka* that extends in substantially parallel relation to top wall 11*e* of housing 10 while floor partition 11*ka* being in spaced relation to top wall 11*e*. The sound guide space (internal space 11*h*) is formed by top wall 11*e* and floor partition 11*ka* of housing 10.

In the speaker device, the floor partition may include one or a plurality of openings. The second speaker may be disposed in the opening of the floor partition to output sound toward the top wall of the housing with its diaphragm exposed to the sound guide space.

It is to be noted that opening 11*kb* and opening 11*kc* are examples of the plurality of openings of the floor partition. Diaphragm 22*a* is an example of the diaphragm of the second speaker.

In the speaker device, the floor partition may include a plurality of openings. The second speaker may be disposed in one of the plurality of openings of the floor partition to output sound toward the top wall of the housing with its diaphragm exposed to the sound guide space. A passive radiator may be disposed in another one of the plurality of openings of the floor partition so that its diaphragm faces the top wall of the housing while the diaphragm being exposed to the sound guide space.

It is to be noted that opening 11*kb* is an example of the one of the openings in the floor partition. Opening 11*kc* is an example of the other one of the openings in the floor partition. First passive radiator 31 is an example of the passive radiator. Diaphragm 31*a* is an example of the diaphragm of the passive radiator.

In the example shown in the first exemplary embodiment, for example, floor partition 11*ka* of speaker device 100 includes opening 11*kb* and opening 11*kc*. Second speaker 22 is disposed in opening 11*kb* to output sound toward top wall 11*e* of housing 10 with its diaphragm 22*a* exposed to the sound guide space (internal space 11*h*). First passive radiator 31 is disposed in opening 11*kc* so that its diaphragm 31*a* faces top wall 11*e* of housing 10 while diaphragm 31*a* being exposed to the sound guide space (internal space 11*h*).

In the speaker device, the passive radiator and the second speaker may have, as their common rear space, a first space that is separate from the sound guide space in the housing.

It is to be noted that internal space 11*g* is the example of the first space.

In the example shown in the first exemplary embodiment, for example, first passive radiator 31 and second speaker 22 of speaker device 100 have, as their common rear space, internal space 11*g* that is separate from (or divided from the sound guide space without communicating with) the sound guide space (internal space 11*h*) in housing 10.

In the speaker device, a horizontal length of the opening formed in the housing may be greater than a diameter of the floor partition's opening in which the second speaker is disposed.

In the example shown in the first exemplary embodiment, for example, the horizontal (X-axis) length of slit 11*aa* formed in housing 10 of speaker device 100 is greater than the diameter of opening 11*kb* in which second speaker 22 is disposed.

The speaker device may include, in a second space that is separate from the sound guide space in the housing, a drive circuit that drives the first speaker and the second speaker. The second space may be formed separately in the housing from a first space that is a rear space for the second speaker.

It is to be noted that internal space 11*i* is the example of the second space. Drive circuit 51 is an example of the drive circuit.

In the example shown in the first exemplary embodiment, for example, speaker device 100 includes, in internal space 11*i* that is separate from (or divided from the sound guide space without communicating with) the sound guide space (internal space 11*h*) in housing 10, drive circuit 51 that drives first speakers 21 and second speaker 22. Internal space 11*i* is formed to be separate from (or to be divided from internal space 11*g* without communicating with) internal space 11*g* that is a rear space for second speaker 22.

In speaker device 100 thus formed, second speaker 22 is disposed in housing 10 with its sound output direction being upward (the positive direction of the Y-axis), so that a vertical (Y-axis) area that second speaker 22 occupies inside housing 10 when disposed is less influenced by aperture size of second speaker 22.

As such, even with a relatively larger aperture of second speaker 22, speaker device 100 can achieve suppressed vertical height (Y-axis dimension) increase of housing 10. In other words, with the vertical height (Y-axis dimension) of speaker device 100 suppressed, second speaker 22 of speaker device 100 can be a subwoofer (or woofer) that has a relatively larger aperture and can suitably reproduce low-range sound.

Speaker device 100 includes the plurality of first speakers 21 oriented forward (in the positive direction of the Z-axis), and these plurality of first speakers 21 are arranged in the horizontal line (along the X-axis). With second speaker 22 being the subwoofer (or woofer) that has the relatively larger aperture and can suitably reproduce low-range sound, first speakers 21 can be small-size full-range speakers that each have an aperture smaller than the aperture of second speaker 22 and can suitably reproduce mid- to high-range sounds, or can be tweeters that can suitably reproduce high-range sounds. Even by these structures, speaker device 100 can have its vertical height (Y-axis dimension) suppressed.

Since second speaker 22 is disposed to output sound into the sound guide space (internal space 11*h*), the sound output into the sound guide space (internal space 11*h*) from second speaker 22 passes through the sound guide space (internal space 11*h*) and is emitted out forwardly of housing 10 (in the positive direction of the Z-axis) through slit 11*aa*. The sound output direction of each of first speakers 21 is forward (the positive direction of the Z-axis), so that sounds output from first speakers 21 are emitted out forwardly of housing 10 (in the positive direction of the Z-axis). As such, the sounds respectively output from first speakers 21 and second speaker 22 of speaker device 100 are emitted out forwardly of housing 10 (in the positive direction of the Z-axis).

Thus, speaker device 100 can be formed to emit the respective sounds of its speakers forward while achieving size increase of the aperture of second speaker 22 and the suppressed vertical height (Y-axis dimension) increase of housing 10. With the aperture size of the speaker increased, an improved low-range output characteristic can be achieved for the speaker. As such, speaker device 100 can even have reinforced low-range output.

With each of first speakers 21 having a relatively smaller aperture and being suited for reproduction of high-range sound or mid- to high-range sounds, such as the full-range speaker or the tweeter, and with second speaker 22 having a relatively larger aperture and being suited for reproduction of low-range sound, such as the subwoofer (or the woofer), speaker device 100 is capable of satisfactory output from low-range sound to high-range sound.

In speaker device 100, the sound guide space (internal space 11*h*) is disposed above second speaker 22 (in the positive direction of the Y-axis) and has the shape that is vertically flattened (along the Y-axis). The vertical height (Y-axis dimension) of the sound guide space (internal space 11*h*) is substantially equal to the vertical height (Y-axis dimension) of slit 11*aa*, which is the opening of the sound guide space (internal space 11*h*). The sound guide space (internal space 11*h*) having such a shape enables a reduced vertical (Y-axis) area that is necessary above second speaker 22 (in the positive direction of the Y-axis) in housing 10 for disposition of the sound guide space (internal space 11*h*). The vertically flattened sound guide space (internal space 11*h*) can increase pressure of sound that is output from second speaker 22 and can allow the sound to spread horizontally and to have directivity toward the front of housing 10 (in the positive direction of the Z-axis) when passing through the sound guide space (internal space 11*h*) to be emitted out of housing 10. Thus, speaker device 100 can provide powerful sound to its user.

In speaker device 100, the sound guide space (internal space 11*h*) opens at slit 11*aa* that is formed in housing 10 to be vertically flattened (along the Y-axis). The vertical height (Y-axis dimension of 1 cm, for example) of slit 11*aa* is smaller than the aperture (e.g. 4 cm) of first speaker 21. By having such a shape, slit 11*aa* of speaker device 100 can allow the second speaker's output sound coming through the sound guide space (internal space 11*h*) to moderately spread horizontally and to have forward directivity from housing 10 (in the positive direction of the Z-axis). As such, even when the user listening to sounds emitted from speaker device 100 shifts his or her head horizontally (in a direction parallel to the X-Z plane), the user can satisfactorily listen to the sound output from second speaker 22.

In speaker device 100, diffusive lead-through part 11*ha* is provided in front of slit 11*aa* (in the positive direction of the Z-axis). This means that sound coming through the sound guide space (internal space 11*h*) is emitted out forwardly of housing 10 through diffusive lead-through part 11*ha* of speaker device 100. Diffusive lead-through part 11*ha* is shaped to broaden vertically (along the Y-axis) while heading forward (in the positive direction of the Z-axis) toward its end. By having such a shape, diffusive lead-through part 11*ha* of speaker device 100 can vertically diffuse (along the Y-axis) the second speaker's output sound that has, as described above, the directivity as a result of coming through the sound guide space (internal space 11*h*) and slit 11*aa* and can allow that sound to have forward directivity (in the positive direction of the Z-axis). As such, even when the user listening to sounds emitted from speaker device 100 shifts his or her head vertically (along the Y-axis), the user can satisfactorily listen to the sound output from second speaker 22.

Speaker device 100 includes the plurality of first speakers 21, and these plurality of first speakers 21 are disposed on the left and right sides (along the X-axis) of slit 11*aa* through which sound output from second speaker 22 exits. In speaker device 100, second speaker 22 having the relatively larger aperture (e.g. 8 cm) suitably outputs low-range sound as compared with first speaker 21. It is known that the lower the sound range, the weaker the sound's directivity is. In speaker device 100, however, first speakers 21 that output high-range sounds of relatively strong directivity are disposed to be oriented forward (in the positive direction of the Z-axis) on both the sides of slit 11*aa* where sound output from second speaker 22 is emitted out forwardly of housing 10 (in the positive direction of the Z-axis). As such, speaker device 100 can suppress displacement of sound to localize ranging from low-range sound output from second speaker 22 to high-range sounds output from first speakers 21 to the position of the particular speaker. When the plurality of first speakers 21 are disposed on a left and right side of second speaker 22, it is to be noted that in consideration of an actual feeling of sound spreading, how the sound is actually heard, and others, first speakers 21 disposed relatively closer to slit 11*aa* may be, for example, speakers having a lower range frequency characteristic (or a higher range frequency characteristic) than that of first speakers 21 disposed relatively farther from slit 11*aa*.

Speaker device 100 includes first passive radiator 31 in housing 10, and first passive radiator 31 and second speaker 22 have, as their common rear space, the first space (internal space 11*g*) that is separate from (or divided from the sound guide space without communicating with) the sound guide space (internal space 11*h*) in housing 10. In speaker device 100 thus formed, first passive radiator 31 resonates with the air vibrated by second speaker 22 in internal space 11*g*, thus producing sound. By having its diaphragm 31*a* vibrated through the resonance, first passive radiator 31 suitably outputs low frequency sound (low-range sound). In this way, speaker device 100 can have low-range sound reinforced.

In speaker device 100, first passive radiator 31 is disposed in housing 10 in such a direction as to output sound into the sound guide space (internal space 11*h*). In other words, first passive radiator 31 is disposed in substantially the same direction as second speaker 22 in housing 10. In speaker device 100 thus formed, the lower range of sound output from second speaker 22 is directly reinforced by first passive radiator 31. In other words, among sounds output from speaker device 100, the low-range sound can be reinforced by first passive radiator 31 in speaker device 100. By being disposed in substantially the same direction as second speaker 22 in housing 10 of speaker device 100, first passive radiator 31 can achieve, similarly to second speaker 22, suppressed vertical height (Y-axis dimension) increase of housing 10 while achieving size increase of its aperture.

Speaker device 100 includes the plurality of passive radiators (first passive radiator 31 and second passive radiator 32), and first passive radiator 31 and second passive radiator 32 are disposed in housing 10 in opposite directions in the vertical direction (along the Y-axis). In speaker device 100 thus formed, first passive radiator 31 and second passive radiator 32 vibrate in the vertically opposite directions (along the Y-axis). As such, speaker device 100 can reduce vibration that might be caused to housing 10 by the vibrations of first and second passive radiators 31 and 32. With either one of first and second passive radiators 31 and 32 being disposed in the same direction as second speaker 22, speaker device 100 can also reduce vibration that might be caused to housing 10 by the vibration of second speaker 22.

In housing 10 of speaker device 100, drive circuit 51 that drives first speakers 21 and second speaker 22 is included in the second space (internal space 11*i*) that is separate from (or divided from the sound guide space without communicating with) the sound guide space (internal space 11*h*). The second space (internal space 110 is formed to be separate from (or to be divided from the first space without communicating with) the first space (internal space 11*g*) that second speaker 22 has as its rear space in housing 10. Speaker device 100 thus formed includes drive circuit 51, first speakers 21, second speaker 22 and the others as one unit in housing 10, so that a system including speaker device 100 and the device (such as television set 1) that is installed to be external to speaker device 100 and is connected to speaker device 100 can be of simplified configuration. In speaker device 100, the second space (internal space 11*i*) accommodating drive circuit 51 is separate from the sound guide space (internal space 11*h*) and the first space (internal space 11*g*), both of which are where air vibration is effected by sound. In other words, drive circuit 51 of speaker device 100 is disposed in the second space (internal space 11*i*) that is divided from and does not communicate with the sound guide space (internal space 11*h*) and the first space (internal space 11*g*) and thus is less susceptible to direct air vibration effected by sound. It is for this reason that drive circuit 51 can have a reduced effect on sound (air vibration effected by sound) in speaker device 100. Because drive circuit 51 is less influenced by direct air vibration effected by sound, deterioration that might gradually be advanced by continuous application of vibration can be suppressed for drive circuit 51.

Other Exemplary Embodiments

The first exemplary embodiment has been described above as being illustrative of the technique disclosed in the present application. However, the above exemplary embodiment is not restrictive of the present disclosure. For example, other exemplary embodiments that are realized by combining the constituent elements of choice that are described in this description or omitting some of the constituent elements may also be exemplary embodiments of the present disclosure. Also included in the present disclosure are modifications that are obtained by making to the above exemplary embodiment various changes that may be conceived of by those skilled in the art without departing from the spirit of the present disclosure, that is to say, the meaning of the recitations in the claims.

Accordingly, some other exemplary embodiments are described below.

In the structural example of speaker device 100 that is described in the first exemplary embodiment, speaker device 100 includes four first speakers 21 and one second speaker 22; however, the present disclosure is not limited to this structural example. Speaker device 100 may include not less than one first speaker 21 and not less than one second speaker 22.

In the structural example of speaker device 100 that is described in the first exemplary embodiment, speaker device 100 includes first speakers 21 on both the sides (along the X-axis) of slit 11*aa* through which sound output from second speaker 22 is emitted. However, the present disclosure is not limited to this structural example. Speaker device 100 may be, for example, of structure that includes first speakers 21 only on one of the sides of slit 11*aa*. Speaker device 100 may be of another alternative structure that includes a plurality of slits 11*aa* and one or more slits 11*aa* may be disposed on both sides of first speakers 21. Speaker device 100 may be of yet another alternative structure that has not less than one first speaker 21 and not less than one slit 11*aa* that are alternately disposed horizontally (along the X-axis). Still yet another speaker device 100 may include a plurality of second speakers 22 that are arranged horizontally (along the X-axis) or depthwise (along the Z-axis) in housing 10.

In the structural example of speaker device 100 that is described in the first exemplary embodiment, speaker device 100 includes the two passive radiators (first passive radiator 31 and second passive radiator 32); however, the present disclosure is not limited to this structural example. Speaker device 100 may include not less than one passive radiator. In the structural example of speaker device 100 that is described in the first exemplary embodiment, first passive radiator 31 is disposed at floor partition 11*ka* that runs along top wall 11*e* of housing 10, while second passive radiator 32 is disposed at bottom wall 11*f* of housing 10. However, the present disclosure is not limited to this structural example. In speaker device 100, the passive radiator may be disposed at any of bottom wall 11*f*, floor partition 11*ka*, front wall 11*a*, side wall 11*c*, side wall 11*d*, and top wall 11*e* of housing 10. In cases where speaker device 100 includes the plurality of passive radiators in housing 10, the passive radiators may respectively be disposed at the housing's walls that face each other as described in the first exemplary embodiment or may respectively be disposed at the housing's walls that do not face each other.

In the structural example of speaker device 100 that is described in the first exemplary embodiment, slit 11*aa*, the sound guide space (internal space 11*h*), and diffusive lead-through part 11*ha* are disposed to be adjacent (or close) to top wall 11*e* of housing 10. However, the present disclosure is not limited to this structural example. Slit 11*aa*, the sound guide space (internal space 11*h*), and diffusive lead-through part 11*ha* of speaker device 100 may be positioned anywhere between top wall 11*e* and bottom wall 11*f* of housing 10 and may be, for example, adjacent to bottom wall 11*f* (in an internal lower position of housing 10).

In the structural example of speaker device 100 that is described in the first exemplary embodiment, slit 11*aa* and diffusive lead-through part 11*ha* are rectangular in shape; however, the present disclosure is not limited to this structural example. Instead of being rectangular, slit 11*aa* and diffusive lead-through part 11*ha* of speaker device 100 may have any shape such as a polygon, a circle, an oval, or an ellipse. In the structural example of speaker device 100 that is described in the first exemplary embodiment, slit 11*aa* and diffusive lead-through part 11*ha* are long horizontally (along the X-axis); however, the present disclosure is not limited to this structural example. Instead of being long horizontally, slit 11*aa* and diffusive lead-through part 11*ha* of speaker device 100 may be long in another direction (e.g. vertically or along the Y-axis).

In the structural example of speaker device 100 that is described in the first exemplary embodiment, diffusive lead-through part 11*ha* diffuses sound, which is output from second speaker 22 and comes through the sound guide space (internal space 11*h*), forwardly of slit 11*aa* (in the positive direction of the Z-axis) between the substantially horizontal line (parallel to the X-Z plane) and the downward line (negative direction of the Y-axis) and allows that sound to have directivity. However, the present disclosure is not limited to this structural example. For example, diffusive lead-through part 11*ha* of speaker device 100 may diffuse sound, which is output from second speaker 22 and comes through the sound guide space (internal space 11*h*), forwardly of slit 11*aa* (in the positive direction of the Z-axis) between the substantially horizontal line (parallel to the X-Z plane) and an upward line (positive direction of the Y-axis), or between the substantially horizontal line (parallel to the X-Z plane) and the upward line (positive direction of the Y-axis) as well as between the substantially horizontal line (parallel to the X-Z plane) and the downward line (negative direction of the Y-axis). Another alternative diffusive lead-through part 11*ha* may diffuse the sound leftward or rightward (along the X-axis), or both.

In the first exemplary embodiment, the described structural example of speaker device 100 is applied for use with television set 1; however, this structural example is not restrictive of the present disclosure. Speaker device 100 may be applied for use with any device that is configured to generate and output audio signals as external outputs.

The exemplary embodiments have been described above as being illustrative of the technique of the present disclosure, and the accompanying drawings and the detailed description have been provided accordingly.

For illustration of the above technique, the constituent elements that are illustrated in the appended drawings and are described in the detailed description may include not only the constituent elements that are essential for solving the problems but also the constituent elements that are not essential for solving the problems. For this reason, those inessential constituent elements that are illustrated in the appended drawings or are described in the detailed description should not immediately be acknowledged as essential.

Since the above exemplary embodiments are intended to be illustrative of the technique of the present disclosure, various modifications, replacements, additions, omissions, and others can be made within the scope of the claims or equivalents of the claims.

INDUSTRIAL APPLICABILITY

The present disclosure is applicable to a speaker device including a plurality of speakers.

REFERENCE MARKS IN THE DRAWINGS

1 television set
1*a* image display surface
2 television stand
10 housing
11 main body
11*a* front wall
11*aa* slit
11*b* rear wall
11*c*, 11*d* side wall
11*e* top wall
11*f* bottom wall
11*fa* depression
11*fb* cover
11*fbb* side part
11*fba*, 11*kb*, 11*kc* opening
11*g*, 11*h*, 11*i* internal space
11*ha* diffusive lead-through part
11*j*, 11*k* partition
11*ka* floor partition
11*kd* guide
12 front panel
13 directional member
13*a* directional surface
21 first speaker
21*a*, 22*a*, 31*a*, 32*a* diaphragm
22 second speaker
22*b* drive unit
31 first passive radiator
32 second passive radiator
51 drive circuit
52 connector
100 speaker device

The invention claimed is:

1. A speaker device comprising:
a housing including a single sound guide space that has a vertically flattened shape;
a plurality of first speakers disposed in the housing and oriented toward a front of the housing; and
a second speaker disposed in the housing, the second speaker being oriented upward or downward to output sound into the single sound guide space that is positioned at an internal upper part or an internal lower part of the housing, wherein
the single sound guide space opens at a first opening that is formed in vertically flattened form in the housing,
the plurality of first speakers are disposed on a left side of the single sound guide space and the first opening, and the plurality of first speakers are disposed on a right side of the single sound guide space and the first opening, and
the first opening has a vertical height that is smaller than an aperture of the plurality of first speakers.

2. A speaker device comprising:
a housing including a single sound guide space that has a vertically flattened shape;
a plurality of first speakers disposed in the housing and oriented toward a front of the housing; and
a second speaker disposed in the housing, the second speaker being oriented upward to output sound into the single sound guide space that is positioned at an internal upper part of the housing, wherein
the single sound guide space opens at a first opening that is formed in vertically flattened form in the housing,
the plurality of first speakers are disposed on left and right sides of the single sound guide space and the first opening, and
the first opening has a vertical height that is smaller than an aperture of the plurality of first speakers.

3. The speaker device according to claim 2, wherein the single sound guide space extends from a front wall of the housing to a rear wall of the housing while the single sound guide space having a vertical height substantially equal to the vertical height of the first opening.

4. The speaker device according to claim 2, wherein
the housing further includes a floor partition that extends in substantially parallel relation to a top wall of the housing while the floor partition being in spaced relation to the top wall, and
the single sound guide space is formed to include the top wall and the floor partition of the housing.

5. The speaker device according to claim 4, wherein
the floor partition includes at least one second opening, and
the second speaker is disposed in the at least one second opening of the floor partition to output sound toward the top wall of the housing with a diaphragm, of the second speaker, exposed to the single sound guide space.

6. The speaker device according to claim 4, wherein
the floor partition includes a plurality of second openings,
the second speaker is disposed in one of the plurality of second openings of the floor partition to output sound toward the top wall of the housing with a diaphragm, of the second speaker, exposed to the single sound guide space, and
a passive radiator is disposed in another one of the plurality of second openings of the floor partition so that a diaphragm of the passive radiator faces the top wall of the housing while the diaphragm being exposed to the single sound guide space.

7. The speaker device according to claim 6, wherein the passive radiator and the second speaker have, as a common rear space, a first space that is separate from the single sound guide space in the housing.

8. The speaker device according to claim 5, wherein a horizontal length of the first opening formed in the housing is greater than a diameter of the second opening in which the second speaker is disposed.

9. The speaker device according to claim 1, further comprising a drive circuit that drives the first speakers and the second speaker, the drive circuit being in a second space that is separate from the single sound guide space in the housing, wherein the second space is formed separately in the housing from a first space that is a rear space for the second speaker.

10. The speaker device according to claim 6, wherein a horizontal length of the first opening formed in the housing is greater than a diameter of the second opening in which the second speaker is disposed.

11. The speaker device according to claim 7, further comprising a drive circuit that drives the first speakers and the second speaker, the drive circuit being in a second space that is separate from the single sound guide space in the housing, wherein the second space is formed separately in the housing from the first space that is a rear space for the second speaker.

12. The speaker device according to claim 1, wherein a plurality of guides are on a floor partition near the first opening in the single sound guide space, and the plurality of guides are belt-shaped projections that are elongated depthwise.

13. The speaker device according to claim 1, wherein an elongated directional member is mounted on the front wall of the housing, and wherein the elongated directional member has a length substantially equal to the width of the first opening.

* * * * *